US005996132A

United States Patent [19]

Sorimachi

[11] Patent Number: 5,996,132

[45] Date of Patent: Dec. 7, 1999

[54] COMPOUND TORQUE HINGE

[75] Inventor: Akira Sorimachi, Kanagawa, Japan

[73] Assignee: Katoh Electrical Machinery Co., Ltd., Kanagawa, Japan

[21] Appl. No.: 09/009,452

[22] Filed: Jan. 20, 1998

[30] Foreign Application Priority Data

Jan. 24, 1997 [JP] Japan ..... 9-011433
Jan. 24, 1997 [JP] Japan ..... 9-011434

[51] Int. Cl.[6] ..... A47K 13/12

[52] U.S. Cl. ..... 4/236; 4/246.2; 4/248; 16/303; 16/306; 16/307

[58] Field of Search ..... 4/234–237, 246.1, 4/246.2, 240, 242.1, 248; 16/50, 303, 305–308; 188/297, 300, 306, 307

[56] References Cited

U.S. PATENT DOCUMENTS 5,165,507 11/1992 Ohshima ..... 4/236
5,398,378 3/1995 Lin ..... 16/303
5,682,644 11/1997 Bohacik et al. ..... 16/303
5,768,718 6/1998 Sorimachi ..... 4/236

*Primary Examiner*—Steven O. Douglas
*Assistant Examiner*—Tuan Nguyen
*Attorney, Agent, or Firm*—Notaro & Michalos P.C.

[57] ABSTRACT

A compound torque hinge comprising a first rotating shaft rotatably mounted through a partition wall within a hinge case having the partition wall; a first rotation control working on the first rotating shaft and mounted on one side of the partition wall of the hinge case; and a second rotation control mean coaxially mounted on the other side of the partition wall of the hinge case. The first rotating shaft is connected to the second rotating shaft of the second rotation control. The first rotating is a cam mechanism provided with spring and the second rotation control is a fluid damper.

6 Claims, 9 Drawing Sheets

COMPOUND TORQUE HINGE

BACKGROUND OF THE INVENTION

1. Field of the Invention

The present invention relates to a compound torque hinge suitable for use for opening and closing an opening-closing body especially of a Western style toilet.

2. Description of the Related Art

As an opening-closing hinge of Western style toilet seat and seat cover, there have been known such hinges as a hinge which is used in a cam mechanism with a compression spring on a rotating shaft, a hinge which uses a torsion spring acting in a direction in which a torque in a specific direction of rotation of the rotating shaft is cancelled, and a hinge using a fluid damper acting on the rotating shaft.

The prior art hinge used in the cam mechanism provided with the compression spring on the rotating shaft has the advantage that a torque produced is easily adjustable to the turning moment of the toilet seat and seat cover. Despite of this advantage, however, the hinge has such a drawback that the use of a large-sized device is needed to obtain a great torque.

Also, the hinge using only the prior art torsion spring on the rotating shaft has the advantage that even a small-sized device can produce a great torque. However, the hinge producing a linearly increasing or decreasing torque is not adjustable to the turning moment of the toilet seat and seat cover that draws a sine curve. The device, therefore, has such a drawback that it is hard to make adjustments of details with respect to the turning moment of the seat and seat cover and also to accentuate operation.

Furthermore, a hinge using only a prior art fluid damper has the drawback that it is hard to make fine adjustment or accentuation in opening and closing the toilet seat and seat cover, and particularly for example to provide a function to stop and hold the toilet seat at an intermediate angle or to apply a brake to the toilet seat from a predetermined angle of opening.

SUMMARY OF THE INVENTION

It is, therefore, an object of the present invention to provide a torque hinge which is capable of obtaining a great torque despite of its small size, and moreover making fine adjustments in relation to the turning moment of an opening-closing body such as the toilet seat and seat cover, and furthermore facilitating operation accentuation.

To accomplish the above-described object, the torque hinge of the present invention is comprised of a first rotating shaft rotatably mounted through a partition wall within a hinge case having the partition wall, a first rotation control means mounted, working on the first rotating shaft, on one side of the partition wall of the hinge case, and a second rotation control means coaxially mounted on the other side of the partition wall of the hinge case; the first rotating shaft being connected with the second rotating shaft of the second rotation control means; the first rotation control means being a cam mechanism provided with an elastic means; and the second rotation control means being a fluid damper.

Also, in the present invention the first rotating shaft is rotatably mounted in the case body of such a structure that the second rotation control means can be mounted; the first rotation control means comprising a cam mechanism with an elastic means on one side portion which is housed in the case body of the first rotating shaft being juxtaposed in two stages; a second rotation control means comprising a fluid damper is provided within the case body in the upper or lower section of the first rotation control means; a driving power transmission means is mounted between the second rotation control means and the first rotation control means; and on the rotating shaft one of mounting sections of the toilet seat or seat cover is rotatably supported on a bearing, while the other is fixed so as to rotate together with the rotating shaft.

In any one of embodiments of the invention, the cam mechanism may be comprised of a stationary cam fixed on the partition wall provided within the hinge case with the rotating shaft inserted in the central part; a rotating-sliding cam which is slidable in the axial direction of the first rotating shaft while engaging with the first rotating shaft, facing the stationary cam; and an elastic means for pushing the rotating-sliding cam towards the stationary cam side.

Furthermore, in any one of embodiments of the present invention, the fluid damper may be comprised of a case body fixed within the hinge case; a second rotating shaft mounted within the case body with one end mounted within the case body; a valve mounted on the second rotating shaft; a viscous fluid filled in the case body; and a stopper piece projecting from the inner peripheral wall of the case body for checking the rotation of the valve.

Furthermore, in any one of the embodiments of the present invention, the valve may be comprised of a blade section projecting from the second rotating shaft and housed within the case body; a groove provided in an axial direction from the edge of the blade section; a long hole provided towards one side in the direction of rotation of the blade section from one side of the groove; a cutout provided from one side of the groove towards the other side in the direction of rotation of the blade section from the other side of the groove; and a valve rockably inserted in the groove for opening and closing the long hole.

And in the present invention, the driving power transmitting means, when used, may be a gearing or a timing belt.

DESCRIPTION OF THE PREFERRED EMBODIMENTS

An opening-closing body such as Western style toilet seat and seat cover embodying the invention will hereinafter be described with reference to the accompanying drawings. It is to be noticed that the present invention is not limited to the embodiments and may be applied to various other types of opening-closing bodies.

Figure 1:
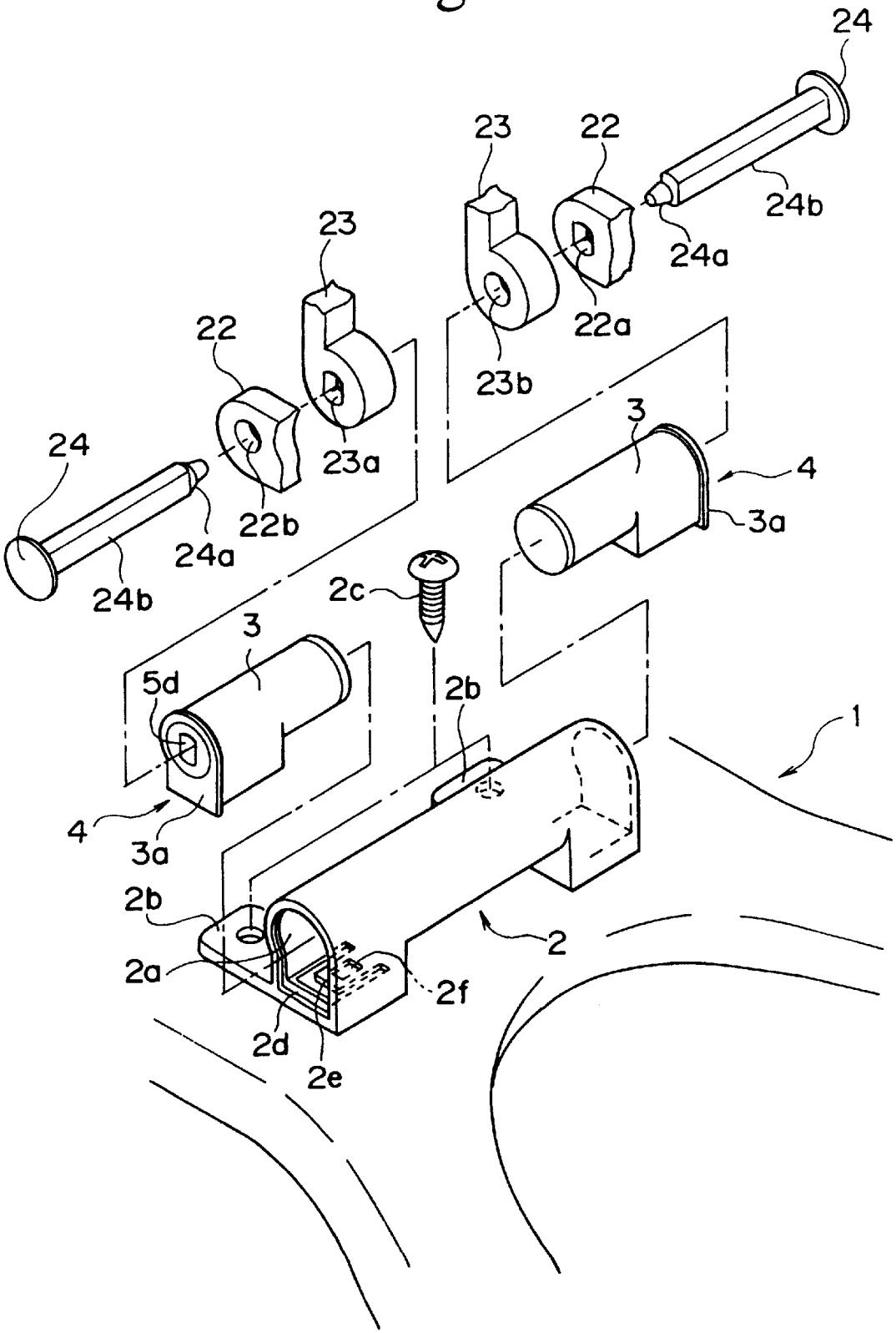
FIG. 1 is an exploded perspective view showing one example of a mounting part for mounting a compound torque hinge of the present invention to a Western style toilet bowl.
Figure 2:
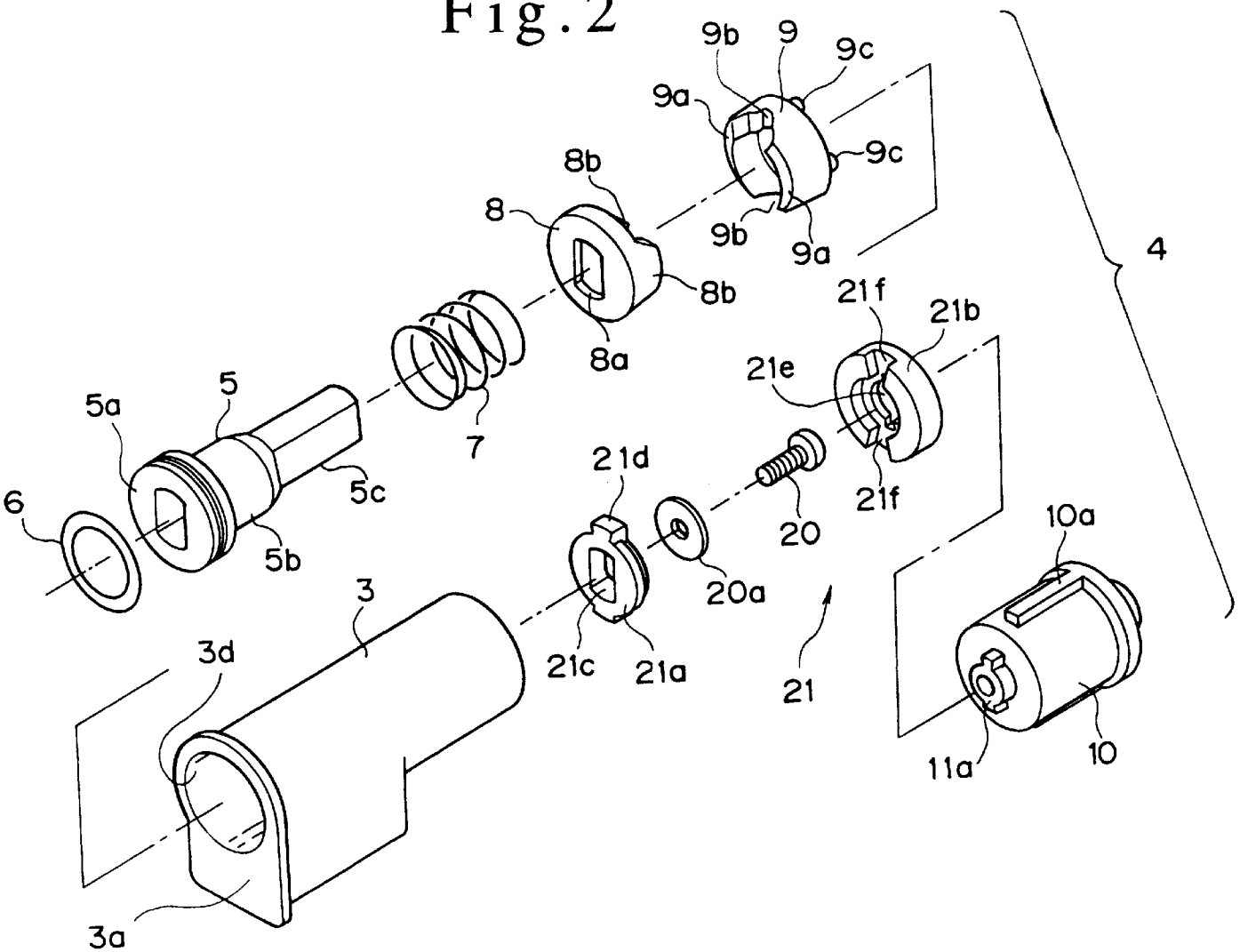
FIG. 2 is a perspective view partly exploded of the compound torque hinge according to the present invention.
Figure 3:
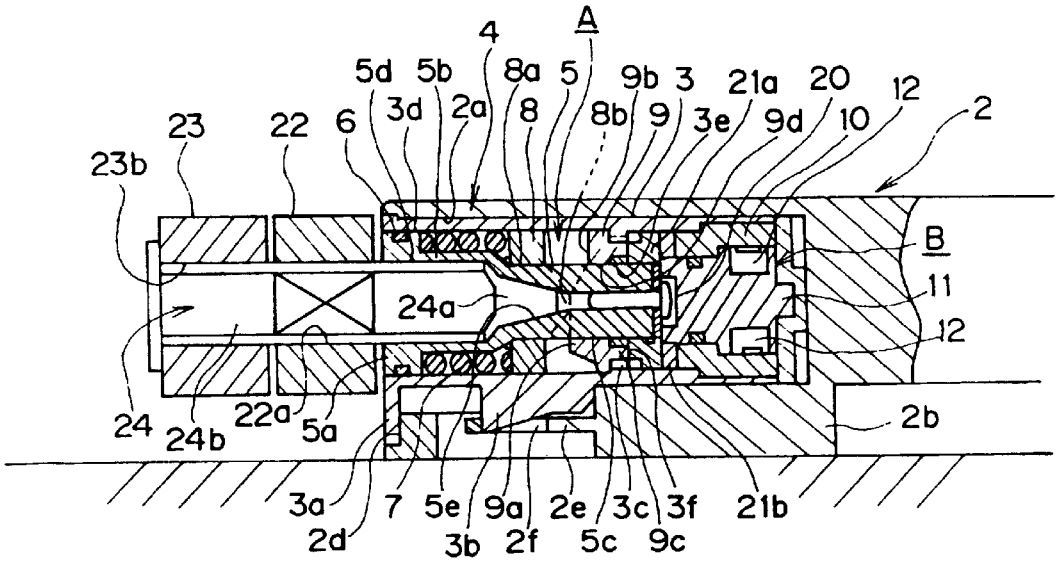
FIG. 3 is a longitudinal sectional view of the compound torque hinge.

In FIG. 1, at about the center of the rear upper surface of a Western style toilet bowl body 1, a mounting cylinder 2 with a pair of mounting holes 2*a* (a hole on one side only is shown) provided at the right and left ends in the axial direction is fixedly mounted by a pair of mounting bolts 2*c* at mounting portions 2*b*, 2*b* projecting towards the rear of both sides. In each mounting hole 2*a* cylindrical hinge cases 3, 3 of a pair of right and left opening-closing devices 4, 4 are removably inserted and fixed. A fixing means for fastening the hinge cases 3, 3 to the mounting cylinder 2 is of such a structure that, particularly as shown in FIGS. 1 to 3, an irregular collar 3*a* is mounted on one end of the hinge case 3 and a lock projection 3*b* (FIG. 3) is provided thereunder. The irregular collar 3*a* is fitted in a lock recess 2*d* provided in the inlet of the mounting hole 2*a* of the mounting cylinder 2 and also the lock projection 3*b* is locked in a lock groove 2*f* of a lock piece 2*e* provided in the mounting hole 2*a*.

The right and left opening-closing devices 4, 4 make a pair as shown in FIG. 1; the left one is for the seat and the right one is for the seat cover. These devices, however, are symmetrical in the internal structure. Therefore only the left opening-closing device 4 in the drawing will be explained.

Figure 4:
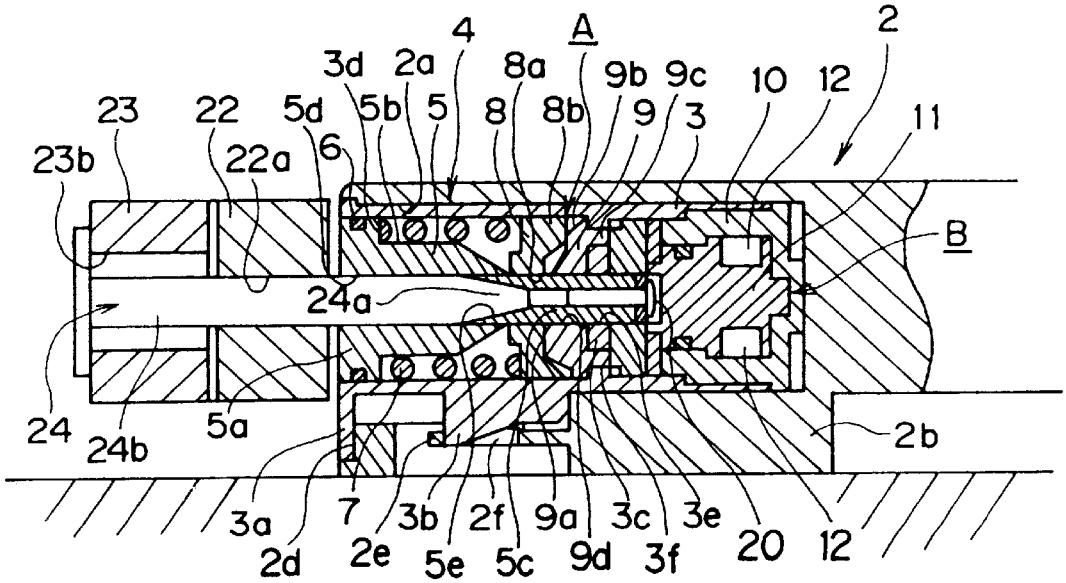
FIG. 4 is a longitudinal sectional view with a toilet seat opened to 90 degrees from the state shown in FIG. 3.

In FIG. 1, particularly as shown in FIGS. 3 and 4, the left opening-closing device 4 is comprised of a first rotation control means A and a second rotation control means B, right and left, on both sides of a partition wall 3*c* provided in the hinge case 3.

Figure 5:
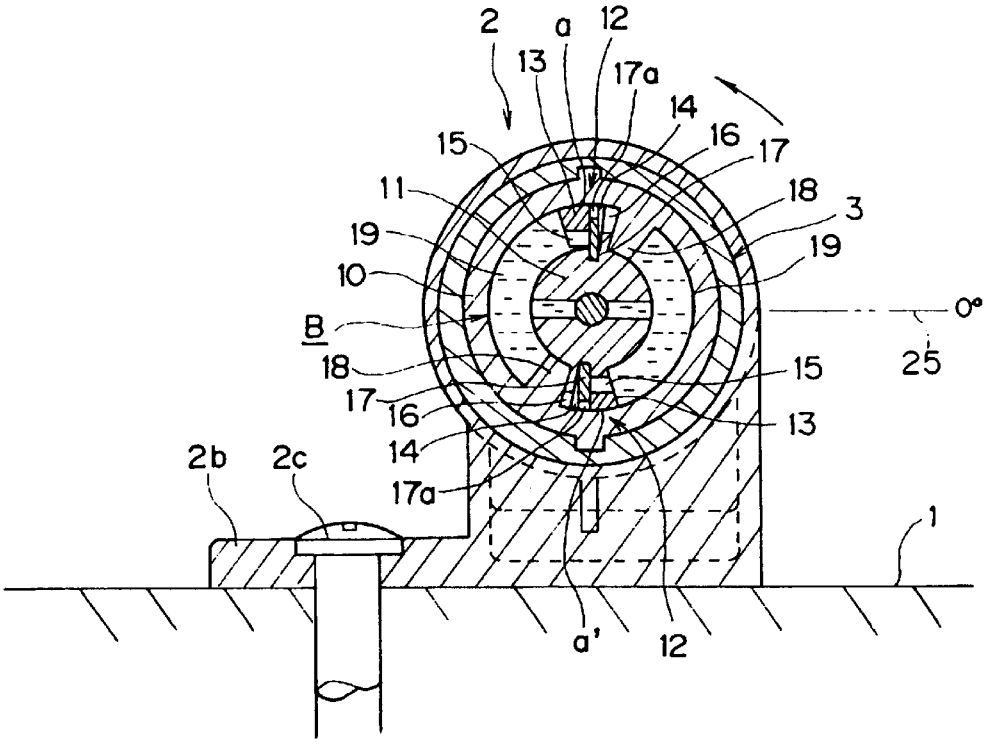
FIG. 5 is a side sectional view of the second rotation control means of the compound torque hinge according to the present invention.
Figure 6:
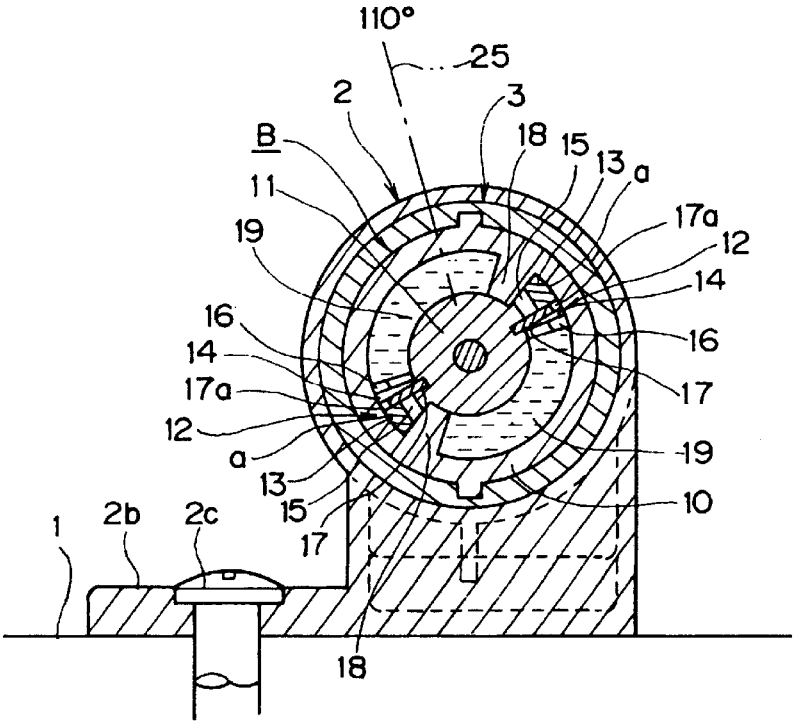
FIG. 6 is a side sectional view of the second rotation control means with the toilet seat opening to 110 degrees from the state shown in FIG. 5.
Figure 7:
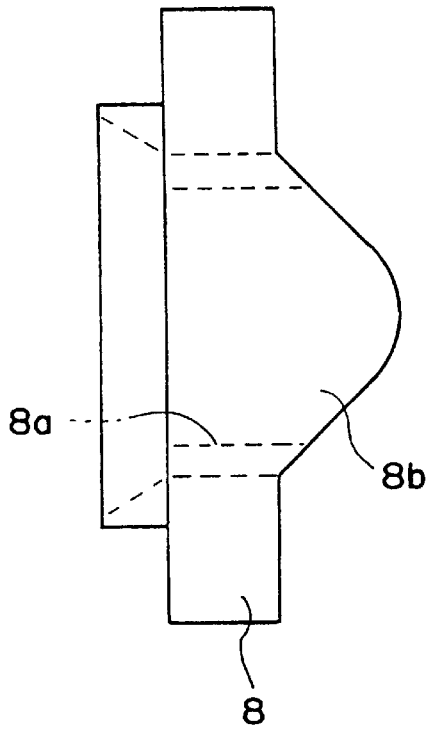
FIG. 7 is a front view of a rotating-sliding cam.
Figure 8:
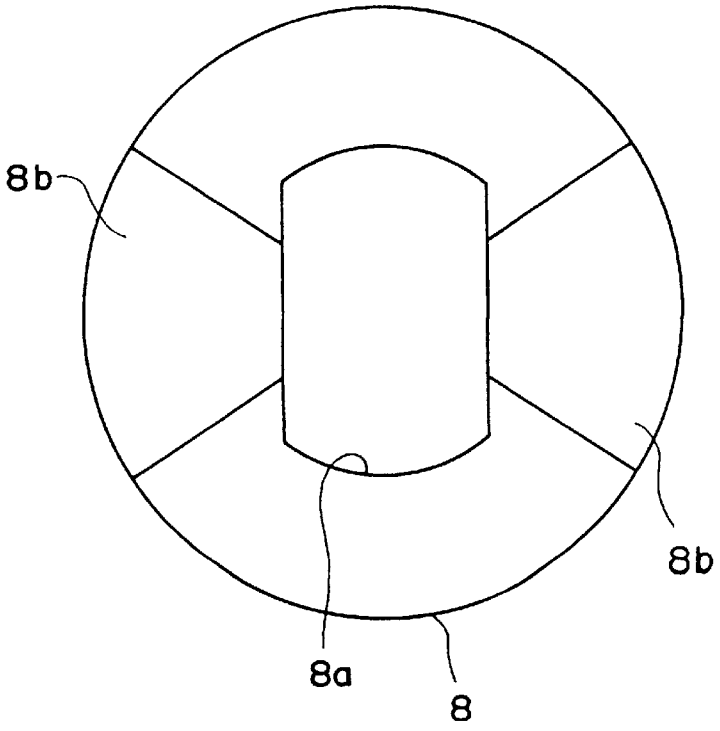
FIG. 8 is a right side view of the rotating-sliding cam shown in FIG. 7.
Figure 9:
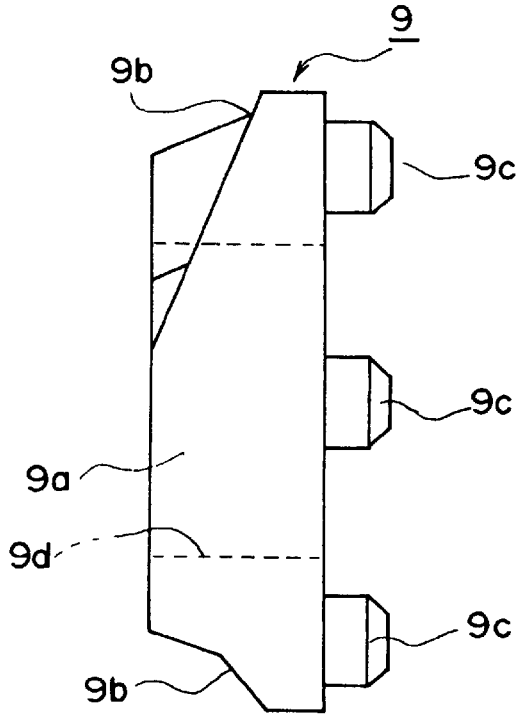
FIG. 9 is a front view of a stationary cam.
Figure 10:
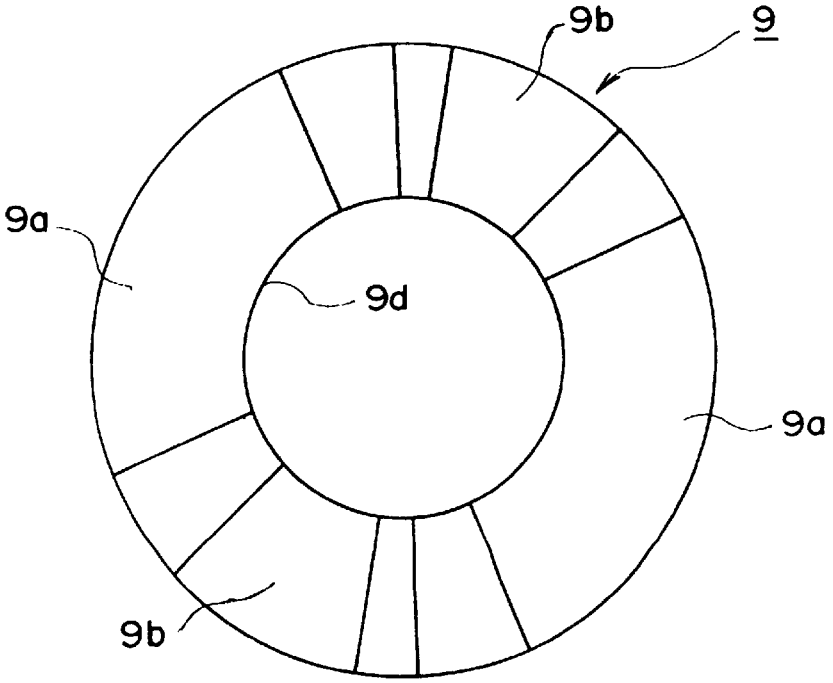
FIG. 10 is a left side view of the stationary cam.
Figure 11:
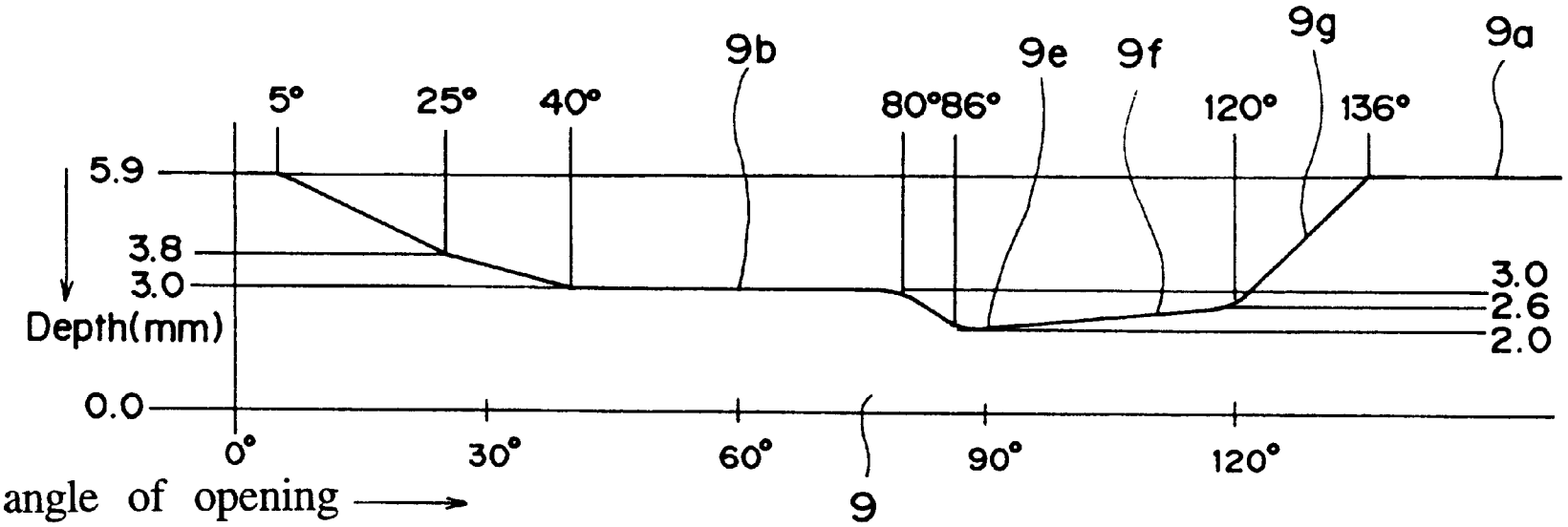
FIG. 11 is a development explaining the shape of the stationary cam.

First, the cam mechanism which is one example of the first rotation control means A will be explained. In the hinge case 3, especially as shown in FIGS. 2 to 4, a first rotating shaft 5 is rotatably mounted in the hinge case 3. The first rotating shaft 5 includes a collar 5*a* with a seal member 6 such as an O-ring mounted in contact with the inner peripheral wall 3*d* of the hinge case 3 attached on the outer periphery from the left end, a large-diameter portion 5*b* with an elastic means 7 consisting of a compression spring wound on the outer periphery, and a small-diameter portion 5*c* of an elliptical sectional form which is slidably inserted in a rotating-sliding cam 8. The small-diameter portion 5*c* is supported by a bearing in a bearing hole 3*e* provided in the partition wall 3*c* which is protrusively provided in the hinge case. The elastic means 7 mentioned above is elastically provided between the collar 5*a* and the rotating-sliding cam 8 to thereby slidably press the rotating-sliding cam 8 in one direction (rightwards in the drawing). The elastic means may be changed to for example a plate spring, spring washer, etc. The rotating-sliding cam 8 has an irregular hole 8*a* of an elliptical sectional form in the axial center, and rotates together with the first rotating shaft 5 with the small-diameter portion 5*c* inserted and engaged in the irregular hole 8*a*. Furthermore, the rotating-sliding cam 8, particularly as shown in FIGS. 5 to 7, projecting portions 8*b*, 8*b* axially bulging out in opposite positions on the outer periphery. On one side of the partition wall 3*c*, particularly as shown in FIGS. 8 to 10, a stationary cam 9 having a pair of convex portions 9*a*, 9*a* axially projecting in opposite positions on the outer periphery of one side and recess portions 9*b*, 9*b* is mounted by pressing four protrusions 9*c* protrusively provided on the other side into a lock hole 3*f* provided in the partition wall 3*c* shown in FIGS. 3 and 4. The small-diameter portion 5*c* of the first rotating shaft 5 is rotatably inserted into an insertion hole 9*d* of a circular sectional form provided in the axial center, and the convex portions 9*a*, 9*a* and recess portions 9*b*, 9*b* are provided oppositely to, and in contact with, the convex portions 8*b*, 8*b* of the rotating-sliding cam 8.

Next, a fluid damper which is one example of the second rotation control means B will be explained. As shown in FIGS. 3, 4, 11 and 12, the second rotating shaft 11 is rotatably mounted within the case body 10 inserted and locked non-rotatably on the right side of the partition wall 3*c* of the hinge case 3. At about the center of the second rotating shaft 11 a pair of valves 12, 12 are mounted in opposite positions. These valves are comprised of the following members.

That is, the valves 12, 12, as shown in FIGS. 5 and 6, are comprised of a pair of blade sections 13, 13 protrusively provided at a spacing of 180 degrees; grooves 14, 14 provided in a radial direction from the of the blade sections 13, 13; long holes 15, 15 provided towards one side in the direction of rotation of the blade sections 13, 13 from one side of the grooves 14, 14; cutouts 16, 16 provided towards the other side in the direction of rotation of the grooves 14, 14; and valves 17, 17 rockably inserted in the grooves 14, 14 and provided with recesses 17*a*, 17*a* on the rocking end side.

On the inner peripheral wall of the case body 10 a pair of stopper pieces 18, 18 are protrusively provided in a radial direction, and contact the surface of the second rotating shaft 11 to separate the interior of the case body 10 into two. The case body 10 is filled with a viscous fluid 19 like for instance silicone oil. Particularly as shown in FIGS. 3 and 4, the portion of the second rotating shaft 11 mounted through the case body 10 and the portion of the first rotating shaft 5 mounted through the partition wall 3*c* are mutually rotatably connected by a coupling means 21 which consists of a stopper member 21*a* and a joint member 21*b* mounted by a mounting screw 20 to the first rotating shaft 5. The second rotation control means using the fluid damper may be installed in a separately defined part in the hinge case 3, not in the case body 10. Also, the second rotation control means using the fluid damper may be mounted above or below, or before or after, the first rotating shaft 5, not coaxially with the first rotating shaft 5, and coupled by a driving power transmitting means with the first rotating shaft.

In the end portion of the first rotating shaft 5 exposed out of the hinge case 3, particularly as shown in FIGS. 1 to 4, there is provided an irregular mounting hole 5*d* axially from the end face. In this irregular mounting hole 5*d* a mounting pin 24 supporting the mounting sections 22 and 23 of the toilet seat and seat cover is pressed. The mounting pin 24 is designed such that the tapered portion 24*a* at the forward end is pressed in a tapered hole 5*e* of the irregular mounting hole 5*d*. In this case, however, the mounting pin 24 may be connected to the first rotating shaft 5 together with the stopper member 21*a* by the mounting screw 20 for mounting the stopper member 21*a* to the fist rotating shaft 5. The mounting pin 24 is an irregular shaft portion 24*b* having an approximately elliptical sectional form, and is so constituted that the irregular shaft portion 24*b* will be inserted for engagement in an irregular hole 22*a* provided in the mounting portion 22 of the toil seat so as to turn together with the mounting section 22. The irregular shaft portion 24*b* is inserted in a round hole 23*b* of a seat cover mounting section 23. Since the hole 23*b* is round in shape, the irregular shaft portion 24*b* will not turn together with the mounting pin 24. The seat cover mounting section 23, being supported on the mounting pin 24, is rotatable on the support of the irregular shaft portion 24*b* of the mounting pin 24. That is, when the toilet seat is opened and closed, the first rotating shaft 5 of the right opening-closing device 4 turns through the mounting pin 24; however, when the seat cover is opened and closed, the first rotating shaft 5 will not turn because the seat cover is supported only by the mounting pin 24.

As shown in FIG. 1, the irregular shaft 24*b* of the other mounting pin 24 inserted, as stated above, in the irregular mounting hole 5*b* of the first rotating shaft 5 on the other left hinge case 3 side is then axially inserted into the round hole 22*b* provided in the seat mounting section 22. The seat mounting section 22, therefore, is rotatable with respect to the right mounting pin 24. However, the irregular shaft portion 24*b* of the mounting pin 24, being so adapted as to be inserted for engagement in the irregular hole 23*a* provided in the seat cover mounting section 23, rotates together with the seat cover mounting section 23. That is, when the seat is opened and closed, the left opening-closing device 4 is supported only at the mounting section 22 by the mounting pin 24 and therefore the first rotating shaft 5 will not rotate to operate the opening-closing device 4. In FIG. 1, therefore, the right opening-closing device 4, as described above, is for the seat, while the left opening-closing device 4 is for the seat cover.

Next, operation will be explained. When the toilet seat 25 is in a closed position as indicated by an imaginary line in FIG. 5, the convex portion 8*b* of the rotating-sliding cam 8 shown in FIGS. 7 and 8 constituting the cam mechanism of the first rotation control means A shown in FIG. 3 is in contact with the convex portion 9*a* of the stationary cam 9 shown in FIGS. 3, 9 and 10 and the elastic means 7 shown in FIG. 3 is in a fully compressed state. The valve 17 of the fluid damper constituting the second rotation control means B shown in FIG. 5 is closed on the long hole 15 side. When the seat 25 is opened from the above state, the first rotating shaft 5 rotates through the mounting pin 24 with which the mounting section 22 is engaged and also the convex portion 8*b* of the rotating-sliding cam 8 rotating in the same direction slides towards the stationary cam 9 side while moving from the convex portion 9*a* of the stationary cam 9 into the recess portion 9*b* side.

In the meantime, the valve 17 of the fluid damper in the second rotation control means B is pushed by the viscous fluid 19 by the rotation of the second rotating shaft 11 which rotates in the same direction as the first rotating shaft 5, rocking in the groove 14 to tilt from the long hole 15 side to the cutout 16 side. Therefore, there will be formed a passage for the viscous fluid 19 running from the cutout 16 through to the opposite side of the blade section 13 via the recess 17*a* and the long hole 15, separately from a clearance between the inner peripheral wall of the case body 10 and the blade section 13.

Figure 12:
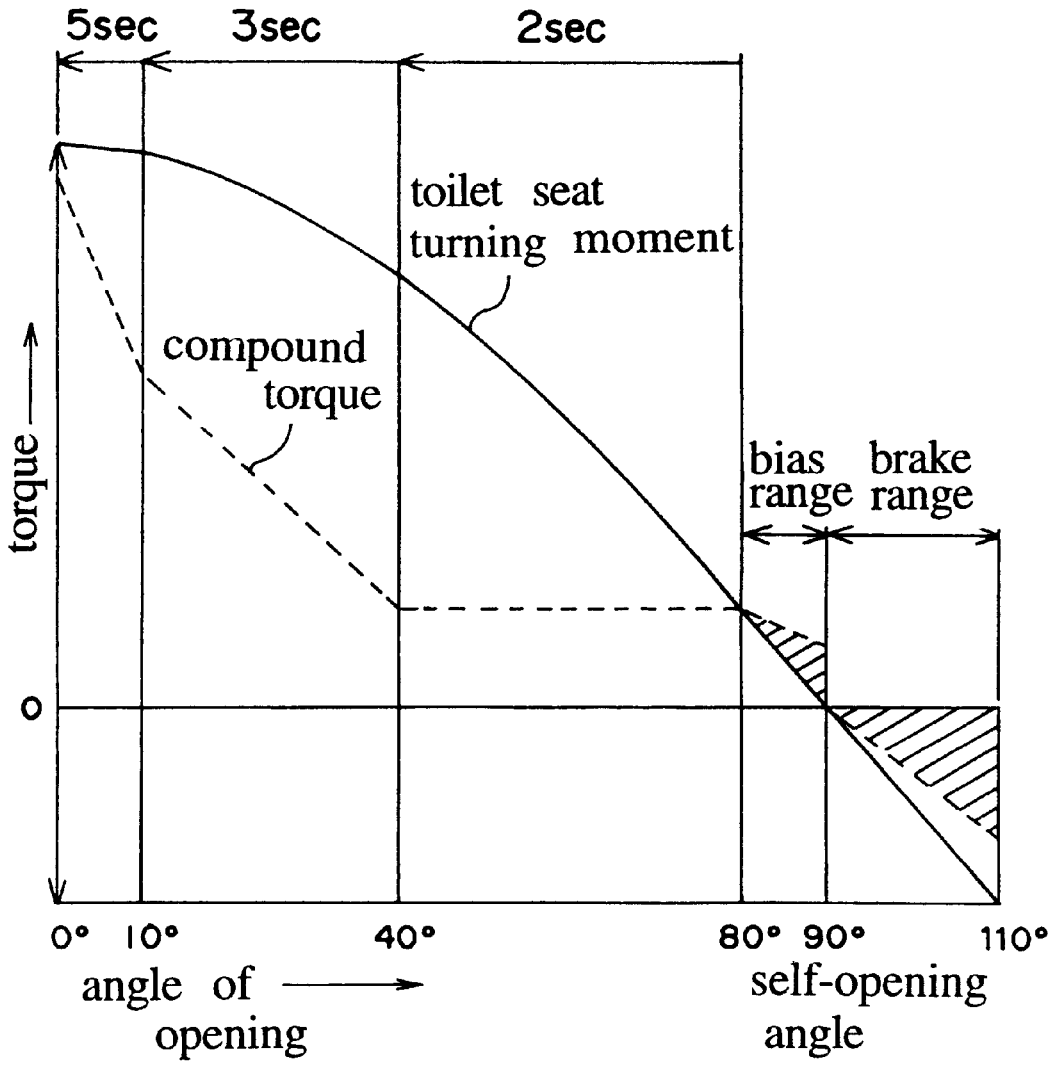
FIG. 12 is a chart showing the torque of the compound torque hinge according to the present invention.

Thus the first rotating shaft 5 and the second rotating shaft 11 are allowed to smoothly rotate, opening the seat 25 to 110 degrees. This state is shown in FIGS. 4 and 12. Particularly as shown in FIG. 12, the blade section 13 of the second rotating shaft 11 contacts the stopper piece 18 of the case body 10, thereby preventing the seat 25 from opening over 110 degrees.

Figure 13:
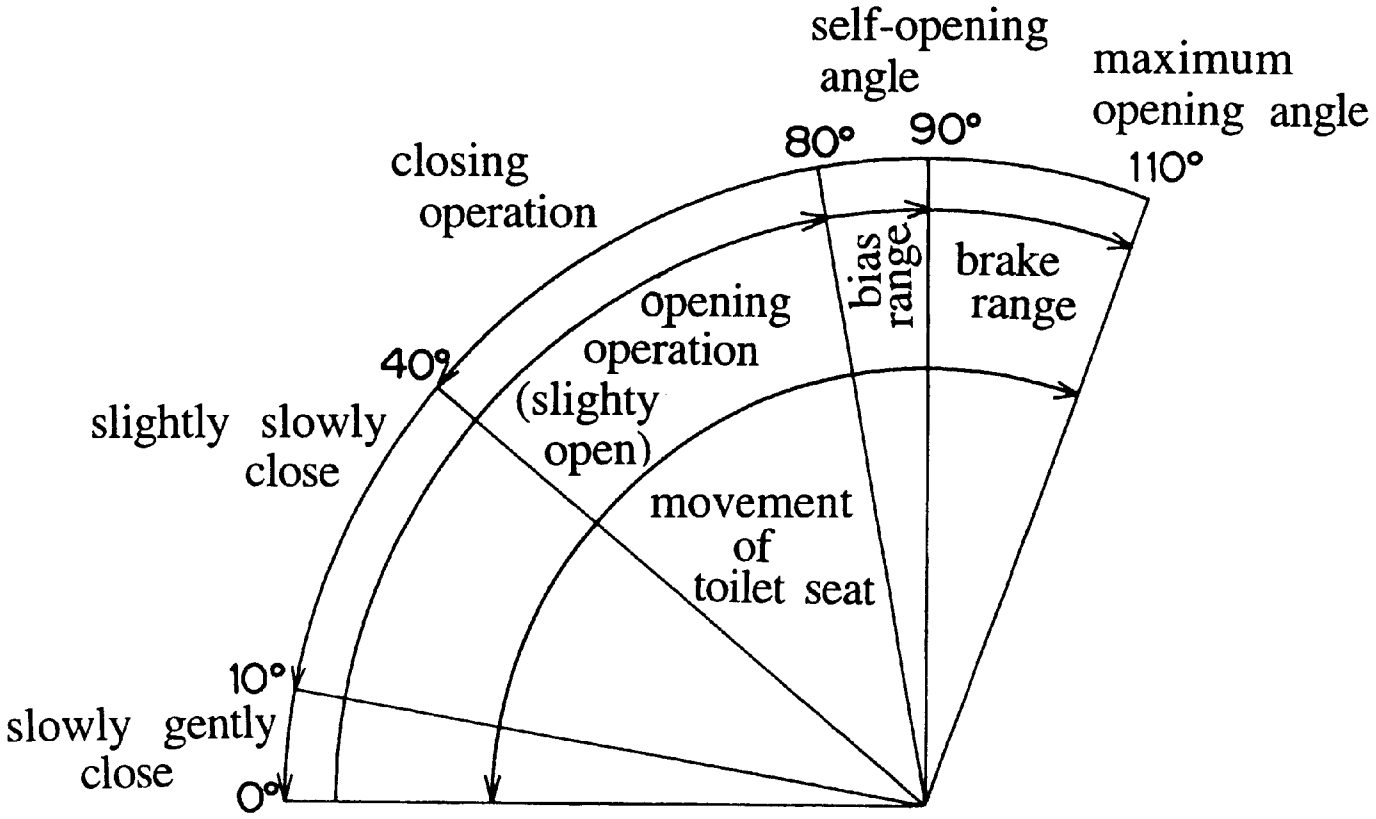
FIG. 13 is an explanatory view of operation of the compound torque hinge according to the present invention.

As the shape of the stationary cam 9 of cam mechanism in FIG. 10, the recess portion 9*b* and further a small recess portion 9*e* are formed, thereby forming a gradually climbing first inclination 9*f* and a sharp second inclination 9*g*. Thus as shown in FIGS. 13 and 14, the seat 25 can be opened automatically, by reducing a cam torque, further from 80 degrees up to 90 degrees at which the cam torque will reach zero. From this position, the seat 25 is opened to the full-open angle of 110 degrees by increasing the cam torque again to apply the brake, thereby absorbing bound and rebound of the seat 25. It is possible to provide seat opening operation with fine accent in accordance with the turning moment.

When the seat 25 is to be closed from the opened position, the cam mechanism of the first rotation control means A performs to reverse the operation explained above. As shown in FIGS. 12 and 13, when the angle of opening of the seat is changed from about 40 degrees to change the position of contact of the convex portion 8*b* of the rotating-sliding cam from the recess portion 9*b* to the convex portion 9*a* of the stationary cam against the elasticity of the elastic means 7, a torque is produced in a reverse direction to cancel the turning moment of the seat, to thereby prevent the abrupt closing of the seat 25. In the meantime, in the fluid damper of the second control means B the viscous fluid 19 is forced, with the closing operation of seat 25, to flow only through a clearance a between the inner periphery of the case body 10 and the blade sections 13, 13 because the valves 17, 17 are rocked reversely in the grooves 14, 14 to close the long holes 15, 15, by the second rotating shaft 11 which rotates in the same direction as the first rotating shaft 5. Thus the damper is actuated to thereby prevent the sudden drop of the seat 25 with the compound torque of the aforesaid cam mechanism and the fluid damper.

The seat 25, when to be closed, therefore, can be smoothly closed without abruptly dropping by the virtue of the torque acting in the reverse direction of the cam mechanism of the first rotation control means and the damping operation of the fluid damper of the second rotation control means B.

In the present embodiment, as shown in FIGS. 13 and 14, when closed to 80 degrees, and then pushed a little downwards and released, the seat 25 is closed to the closing angle of about 40 degrees at a relatively high speed, in about two seconds, by a low cam torque and damping operation. Thereafter, the convex portions 8*b*, 8*b* of the rotating-sliding cam 8 of the cam mechanism contact the convex portions 9*a*, 9*a* of the stationary cam 9 and go upwards along the convex portions 9*a*, 9*a* against the elastic force of the elastic means 7; therefore the seat 25 is slowly closed to the closing angle of about 10 degrees. Thereafter the seat is further closed slowly to 0 degree in about five seconds.

The operation time required for operating the seat 25 is adjusted by the use of a compound torque which is a combination of the cam torque produced by the cam mechanism and the damping operation of the fluid damper, to thereby ensure smooth, effective movement of the seat 25.

Only the opening-closing device 4 for the left toilet seat 25 has heretofore been described. The opening-closing device 4 for the right seat cover is also operated to operate the seat cover from the closed position. However, since the seat cover is not so frequently operated as the seat 25, it is not so much required to provide, unlike the seat 25, the opening-closing operation with fine accent. It is, therefore, possible to use a stationary cam of much simpler shape. However, because the turning moment is basically the same as that in the case of the seat, only the shape of the stationary cam is different and the structure is the same in other respects and therefore will not be described.

What is claimed is:

1. A compound torque hinge, comprising:

a first rotating shaft rotatably mounted through a partition wall inside a hinge case provided with said partition wall;

a first rotation control means provided for the control of rotation of said first rotating shaft on one side of said partition wall of said hinge case; and a second rotation control means axially provided on the other side of said partition wall of said hinge case;

said first rotating shaft being coupled with a second rotating shaft of said second rotation control means;

said first rotation control means being a cam mechanism provided with an elastic means; and said second rotation control means being a fluid damper.

2. A compound torque hinge, comprising:

a first rotating shaft rotatably mounted through a partition wall inside a hinge case provided with said partition wall;

a first rotation control means provided for the control of rotation of said first rotating shaft on one side of said partition wall of said hinge case; and a second rotation control means axially provided on the other side of said partition wall of said hinge case;

said first rotating shaft being coupled with a second rotating shaft of said second rotation control means;

said first rotation control means being a cam mechanism provided with an elastic means; and said second rotation control means being a fluid damper;

said cam mechanism including a stationary cam secured on said partition wall provided in said hinge case with said rotating shaft inserted in the center;

a rotating-sliding cam which faces said stationary cam, is slidable in the axial direction of said first rotating shaft, and is engaged with said first rotating shaft; and said elastic means for pushing said rotating-sliding cam towards said stationary cam side.

3. A compound torque hinge, comprising:

a first rotating shaft rotatably mounted through a partition wall inside a hinge case provided with said partition wall;

a first rotation control means provided for the control of rotation of said first rotating shaft on one side of said partition wall of said hinge case; and a second rotation control means axially provided on the other side of said partition wall of said hinge case;

said first rotating shaft being coupled with a second rotating shaft of said second rotation control means;

said first rotation control means being a cam mechanism provided with an elastic means; and said second rotation control means being a fluid damper; and furthermore said fluid damper being comprised of a case body secured inside said hinge case, said second rotating shaft mounted in said case body with one end protruding out of said case body, a valve provided on said second rotating shaft, a viscous fluid filled in said case body, and a stopper piece protruding from the inner peripheral wall of said case body for preventing said valve from turning.

4. A compound torque hinge, comprising:

a first rotating shaft rotatably mounted through a partition wall inside a hinge case provided with said partition wall;

a first rotation control means provided for the control of rotation of said first rotating shaft on one side of said partition wall of said hinge case; and a second rotation control means axially provided on the other side of said partition wall of said hinge case;

said first rotating shaft being coupled with a second rotating shaft of said second rotation control means;

said first rotation control means being a cam mechanism provided with an elastic means; and said second rotation control means being a fluid damper;

said fluid damper being comprised of a case body secured inside said hinge case, said second rotating shaft mounted in said case body with one end protruding out of said case body, a valve provided on said second rotating shaft, said viscous fluid filled in said case body, and a stopper piece protruding from the inner peripheral wall of said case body for preventing said valve from turning; and furthermore said valve being comprised of a blade section protruding from said second rotating shaft and housed in said case body, a groove axially formed from the edge of said blade section, a long hole formed with and through said blade section, a cutout formed from another side of said groove towards another side in the direction of rotation of said blade section, and said valve rotatably mounted in said groove for opening and closing said long hole.

5. A compound torque hinge, comprising:

a first rotating shaft rotatably mounted through a partition wall inside a hinge case provided with said partition wall;

a first rotation control means provided for the control of rotation of said first rotating shaft on one side of said partition wall of said hinge case; and a second rotation control means axially provided on the other side of said partition wall of said hinge case;

said first rotating shaft being coupled with a second rotating shaft of said second rotation control means;

said first rotation control means being a cam mechanism provided with an elastic means; and said second rotation control means being a fluid damper;

said cam mechanism including a stationary cam secured on said partition wall provided in said hinge case with said rotating shaft inserted in the center;

a rotating-sliding cam which faces said stationary cam, is slidable in the axial direction of said first rotating shaft, and is engaged with said first rotating shaft;

an elastic means for pushing said rotating-sliding cam towards said stationary cam side; and said damper being comprised of a case body secured in said hinge case, said second rotating shaft mounted in said case body with one end projecting from said case body, a valve mounted on said second rotating shaft, a viscous fluid filled in said case body, and a stopper piece protruding from the inner peripheral wall of said case body for checking rotation of said valve.

6. A compound torque hinge, comprising:

a first rotating shaft rotatably mounted through a partition wall inside a hinge case provided with said partition wall;

a first rotation control means provided for the control of rotation of said first rotating shaft on one side of said partition wall of said hinge case; and a second rotation control means axially provided on the other side of said partition wall of said hinge case;

said first rotating shaft being coupled with a second rotating shaft of said second rotation control means;

said first rotation control means being a cam mechanism provided with an elastic means; and said second rotation control means being a fluid damper;

said cam mechanism including a stationary cam secured on said partition wall provided in said hinge case with said rotating shaft inserted in the center;

a rotating-sliding cam which faces said stationary cam, is slidable in the axial direction of said first rotating shaft, and is engaged with said first rotating shaft;

an elastic means for pushing said rotating-sliding cam towards said stationary cam side;

said damper being comprised of a case body secured in said hinge case, said second rotating shaft mounted in said case body with one end projecting from said case body, a valve mounted on said second rotating shaft, a viscous fluid filled in said case body, and a stopper piece protruding from the inner peripheral wall of said case body for checking rotation of said valve;

said fluid damper being comprised of a case body secured in said hinge case;

and furthermore said valve being comprised of a blade section projecting from said second rotating shaft and housed in said case body, a groove formed axially from the edge of said blade section, a long hole formed within and through said blade section, a cutout formed from another side of said groove towards another side in the direction of rotation of said blade section, and said valve rotatably housed in said groove for opening and closing said long hole.

* * * * *